United States Patent [19]

Kurokawa et al.

[11] Patent Number: 4,848,232

[45] Date of Patent: Jul. 18, 1989

[54] METHOD OF ELECTRICALLY BLASTING A PLURALITY OF DETONATORS AND ELECTRIC BLASTING APPARATUS FOR USE IN SAID METHOD

[75] Inventors: Koichi Kurokawa; Takeo Ueda; Yoshiro Osumi, all of Chita, Japan

[73] Assignee: Nippon Oil and Fats Company, Limited, Tokyo, Japan

[21] Appl. No.: 129,136

[22] Filed: Dec. 7, 1987

[30] Foreign Application Priority Data

Dec. 10, 1986 [JP] Japan ..... 61-292556

[51] Int. Cl.[4] ..... F42C 11/16; F42D 1/06

[52] U.S. Cl. ..... 102/200; 102/206

[58] Field of Search ..... 102/200, 206, 217, 218, 102/301

[56] References Cited

U.S. PATENT DOCUMENTS

| | | | |
|---|---|---|---|
| 3,750,586 | 8/1973 | Swallow et al. | 102/206 |
| 3,752,081 | 8/1973 | McKeown et al. | 102/206 |
| 3,757,697 | 9/1973 | Phinney | 102/206 |
| 3,953,804 | 4/1976 | Dethlefsen et al. | 328/130 |
| 4,297,947 | 11/1981 | Jones et al. | 102/206 |
| 4,601,243 | 7/1986 | Ueda et al. | 102/200 |
| 4,615,268 | 10/1986 | Nakano et al. | 102/200 |

FOREIGN PATENT DOCUMENTS

| | | |
|---|---|---|
| 0096482 | 12/1983 | European Pat. Off. . |
| 2356875 | 5/1975 | Fed. Rep. of Germany . |
| 2079907 | 1/1982 | United Kingdom . |

*Primary Examiner*—Charles T. Jordan

*Attorney, Agent, or Firm*—Parkhurst, Oliff & Berridge

[57] ABSTRACT

An apparatus for electrically blasting a number of electric detonators arranged at a plurality of working faces, including a single controller having a power source unit for supplying a D.C. voltage and a plurality of ignition control units for selectively applying the D.C. voltage; a plurality of oscillators each arranged near respective working faces, the number of the oscillators corresponding to that of the ignition control units, each oscillator being energized with the D.C. voltage to generate a high frequency current and being connected to respective ignition control units via an electric wire bundle; and a plurality of lead wires each connected to outputs of respective oscillators. Loop-like leg wires of electric detonators are electro-magnetically coupled with the lead wires with the aid of transformer magnetic cores.

15 Claims, 5 Drawing Sheets

METHOD OF ELECTRICALLY BLASTING A PLURALITY OF DETONATORS AND ELECTRIC BLASTING APPARATUS FOR USE IN SAID METHOD

BACKGROUND OF THE INVENTION

Field of the Invention and Related Art Statement

The present invention generally relates to and electric blasting technique and more particularly to a method of electrically blasting a plurality of electric detonators provided at a plurality of working or exploding faces by centrally controlling a plurality of blasting devices arranged near respective working faces. This invention also relates to an apparatus for electrically blasting a plurality of electric detonators.

There has been proposed a method of electrically exploding a plurality of electric detonators which are electromagnetically coupled with a lead wire by means of transformer magnetic cores by supplying a pulsatory high frequency current to the lead wire. When the high frequency current is supplied to the lead wire, a secondary high frequency current is induced in a leg wire of an electric detonator. Then, a current flows through a fusehead of the detonator and the detonator is blasted. Such a method is described in U.S. Pat. No. 4,601,243 issued on July 22, 1986.

FIG. 1 is a schematic view illustrating this known method. To an electric blasting device 1 comprising an electric power source and an oscillator for generating a high frequency current, is connected a lead wire 2 having loop portions 2A with which transformer magnetic cores 3 are electromagnetically coupled. With the magnetic core 3 is further electromagnetically coupled loop-like wires 5 which are connected to fuseheads of detonators 4. When the pulsatory high frequency current is supplied from the electric blasting device 1 to the lead wire 2, a high frequency current is induced in each loop-like wire 5 via the magnetic core 3 by means of the electromagnetic induction. Then, the fusehead in the detonator 4 is heated to fire a detonating explosive.

In such a method, a pair of leg wires of the detonator are connected in the form of the loop wire 5, and thus leg wires are considered to be always short-circuited from the operation of coupling the loop wire 5 with the lead wire 2 via the magnetic core 3 to the actual exploding operation and the electric energy is hardly introduced into the loop wire. Therefore, any undesired explosion of the detonator can be effectively prevented.

In the known blasting method explained above, since the explosion is carried out at only a single working or blasting face with the aid of a single blasting device, when it is required to perform the explosion at a plurality of working faces, it is necessary to effect the explosion at working faces successively in time. Therefore, when the explosion has to be performed at a large number of locations such as in a mine of a large scale, difficult and complicated works are required in the warning of the explosion at different locations and the blasting time period is naturally prolonged so that the efficiency of blasting is very low. Further, care should be taken for ventilating the after-gas produced by the explosion. Moreover, the electric blasting device used in the known blasting method comprises both a power source unit for generating D.C. supply voltage and an oscillating unit for generating the high frequency pulsatory pulse in the same housing. Therefore, when the electric blasting device has to be placed at a location which is remote from the working face by, for instance, several kilometers, a very long lead wire must be used. In the electromagnetic induction type electric blasting method shown in FIG. 1, the impedance matching is effected in order to reduce a loss of the high frequency signal. Moreover, when use is made of the lead wire having the very long length up to several kilometers, the transmission loss could not be limited even by the impedance matching, so that it is rather difficult to transmit the sufficiently large electric energy for exploding the detonators positively. Therefore, in the known method, the length of the lead wire is limited to a relatively small distance such as several hundred meters.

SUMMARY OF THE INVENTION

The present invention has for its object to provide a novel and useful method of electrically blasting a number of electric detonators in a simple, efficient and positive manner within a short time period.

It is another object of the invention to provide an electric blasting apparatus for use in the electromagnetic induction type electric blasting method, by means of which a plurality of electric detonators can be exploded in a simple, safe and efficient manner.

According to the invention, a method of electrically blasting a plurality of electric detonators arranged at different locations, comprises the steps of:

arranging a plurality of electric detonators at each blasting face, each electric detonator including leg wires;

arranging a plurality of electric blasting devices near respective blasting faces, each electric blasting device including a charging/discharging unit;

coupling said leg wires of the electric detonators arranged at each blasting face with an electric blasting device arranged near the relevant blasting face;

arranging a controller at a location suitable for controlling said plurality of electric blasting devices in a central control mode, said controller including a power source unit for generating a D.C. current and an ignition control unit;

connecting said plurality of electric blasting devices to said controller by means of electric wires;

supplying the D.C current generated by said power source unit of the controller to the electric blasting devices via said electric wires to store electric energy in said charging/discharging units in the electric blasting devices; and discharging the electric energy stored in the charging/discharging units in the electric blasting devices such that electric currents flow through the leg wires of the electric detonators to explode the electric detonators.

According to further aspect of the invention, an apparatus for blasting a plurality of electric detonators comprises a controller including a power source unit for generating a D.C. voltage and an ignition control unit for selectively supplying said D.C voltage;

a plurality of oscillators each of which is connected to said controller by means of electric wires, and comprises a charge/discharge unit energized with the D.C. voltage applied from said controller and discharging stored electric charge in accordance with a command supplied from said controller, a high frequency conversion unit for converting the discharged electric charge into high frequency energy, and an oscillation unit energized with said high frequency energy for generating a high frequency current having a predetermined frequency;

a plurality of lead wires each being connected to respective oscillators; and a plurality of transformer cores electromagnetically coupled with said lead wires;

whereby loop-like wires of electric detonators are electromagnetically coupled with said transformer cores.

DESCRIPTION OF THE PREFERRED EMBODIMENT

Figure 1:
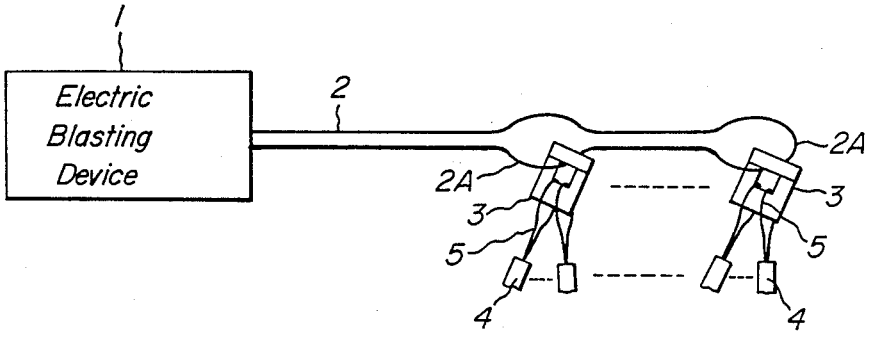
FIG. 1 PRIOR ART
FIG. 1 is a schematic view showing a known method of blasting detonators in an electromagnetic induction mode.
Figure 2:
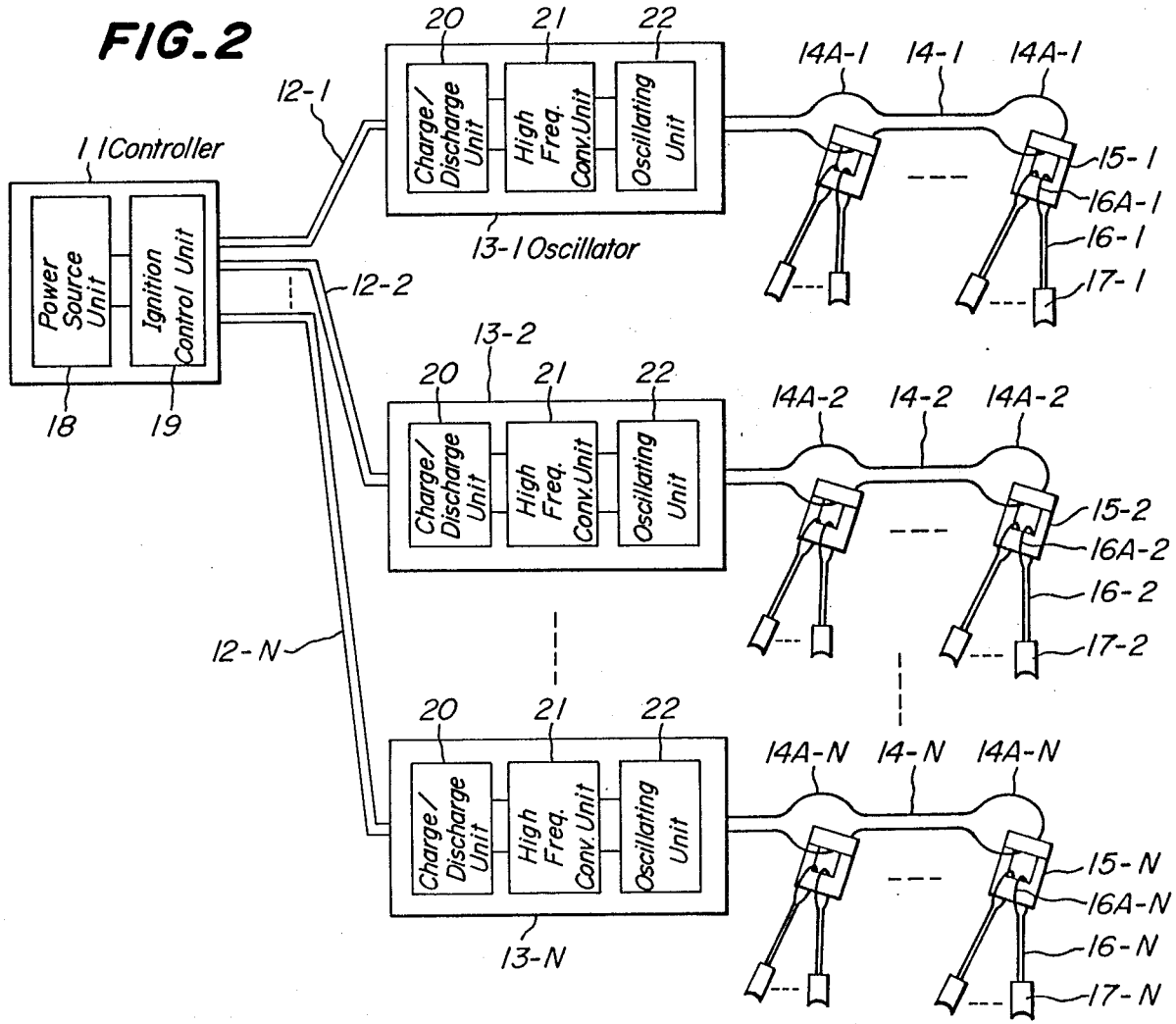
FIG. 2 is a schematic view illustrating a basic conception of the electric blasting method according to the invention.

FIG. 2 is a block diagram showing a principal construction of the electric blasting apparatus according to the invention for use in the electric blasting method according to the invention. According to the invention, to a single controller 11 are connected a plurality of electric blasting devices, i.e. oscillators 13-1, 13-2, . . . 13-N by means of electric wire bundles 12-1, 12-2, . . . 12-N each oscillator being arranged near respective working or exploding faces. To each oscillator 13-1, 13-2, . . . 13-N are connected respective lead wires 14-1, 14-2, . . . 14-N having loop portions 14A-1, 14A-2, . . . 14A-N. A plurality of transformer magnetic cores 15-1, 15-2, . . . 15-N are electromagnetically coupled with the loop portions 14A-1, 14A-2, . . . 14A-N of lead wires 14-1, 14-2, . . . 14-N. Further, loop portions 16A-1, 16A-2, . . . 16A-N of leg wires 16-1, 16-2, . . . 16-N of electric detonators 17-1, 17-2, . . . 17-N are also electromagnetically coupled with the transformer cores 15-1, 15-2, 15-N. The construction of the lead wires conneted to the oscillators, the transformer cores coupled with the lead wires, the loop portions of leg wires of the electric detonators is same as that of the known method shown in FIG. 1.

The controller 11 comprises a power source unit 18 for generating a D.C. voltage having a predetermined value, and an ignition control unit 19 for applying the D.C. voltage simultaneously or selectively to the oscillators 13-1, 13-2, 13-N and for transmitting ignition command simultaneously or selectively to the oscillators. The oscillators 13 1, 13-2, . . . 13-N have the identical construction and each oscillator comprises a charge/discharge unit 20 for charging electric charge supplied from the controller 11 via the electric wire bundle and discharging the electric charge in response to the ignition command transmitted from the controller, a high frequency conversion unit 21 for converting the discharged electric charge into high frequency energy, and an oscillating unit 22 energized with the high frequency energy to generate a high frequency current.

Now the operation of the electric blasting apparatus shown in FIG. 2 will be explained. When a power switch provided in the power source unit 18 is closed, the D.C. voltage is applied to the ignition control unit 19. The D.C. voltage may be obtained by rectifying and boosting commercially available A.C. voltage of 100 volts with the aid of a known AC-DC rectifier. The D.C. voltage has preferably a value of 150~500 volts. The ignition control unit 19 may be formed by a switching circuit and can apply the D.C. voltage to the electric wire bundles 12-1, 12-2, 12-N simultaneously or selectively. The charge/discharge unit 20 of the oscillator includes capacitor which is charged with the D.C. voltage applied from the controller 11 through.the electric wire bundle. After the capacitors in the oscillators 13-1, 13-2, . . . 13-N have been charged to a given level, the ignition commands are supplied from the ignition control unit 19 in the controller 11 to the oscillators via the electric wire bundles 12-1, 12-2, . . . 12-N. It should be noted the ignition commands may be transmitted simultaneously or selectively. Then, the electric charge in the capacitors is discharged. The discharged electric energy is supplied to the high frequency converting units 21 and is converted thereby into the high frequency energy. The high frequency energy is then supplied to the oscillating unit 22 which produces th high frequency current. The high frequency current is supplied to the lead wires 14-1, 14-2, . . . 14-N. Therefore, due to the electromagnetic induction, high frequency currents are induced in loop portions 16A-1, 16A-2, . . . 16A-N with the aid of the transformer cores 15-1, 15-2, . . . 15-N and the high frequency currents flow through the leg wires 16-1, 16-2, . . . 16-N and fuseheads of the electric detonators 17-1, 17-2, . . . 17-N.

As explained above, the single controller 11 and a plurality of oscillators 13-1, 13 2, . . . 13-N are electrically connected by means of the electric wire bundles 12-1, 12-2, 12-N and the D.C. currents flow through the electric wire bundles. Therefore, even if the electric wire bundles are long, the transmission loss of the electric energy can be restricted to a small level and thus, a large number of electric detonators can be positively exploded. Further, a large number of oscillators 13-1, 13-2, 13-N can be controlled or managed by the single controller 11 in a central control mode, and therefore the working faces and their neighboring places can be completely free from workers and the blasting operation can be performed in an efficient and safe manner.

Figure 3:
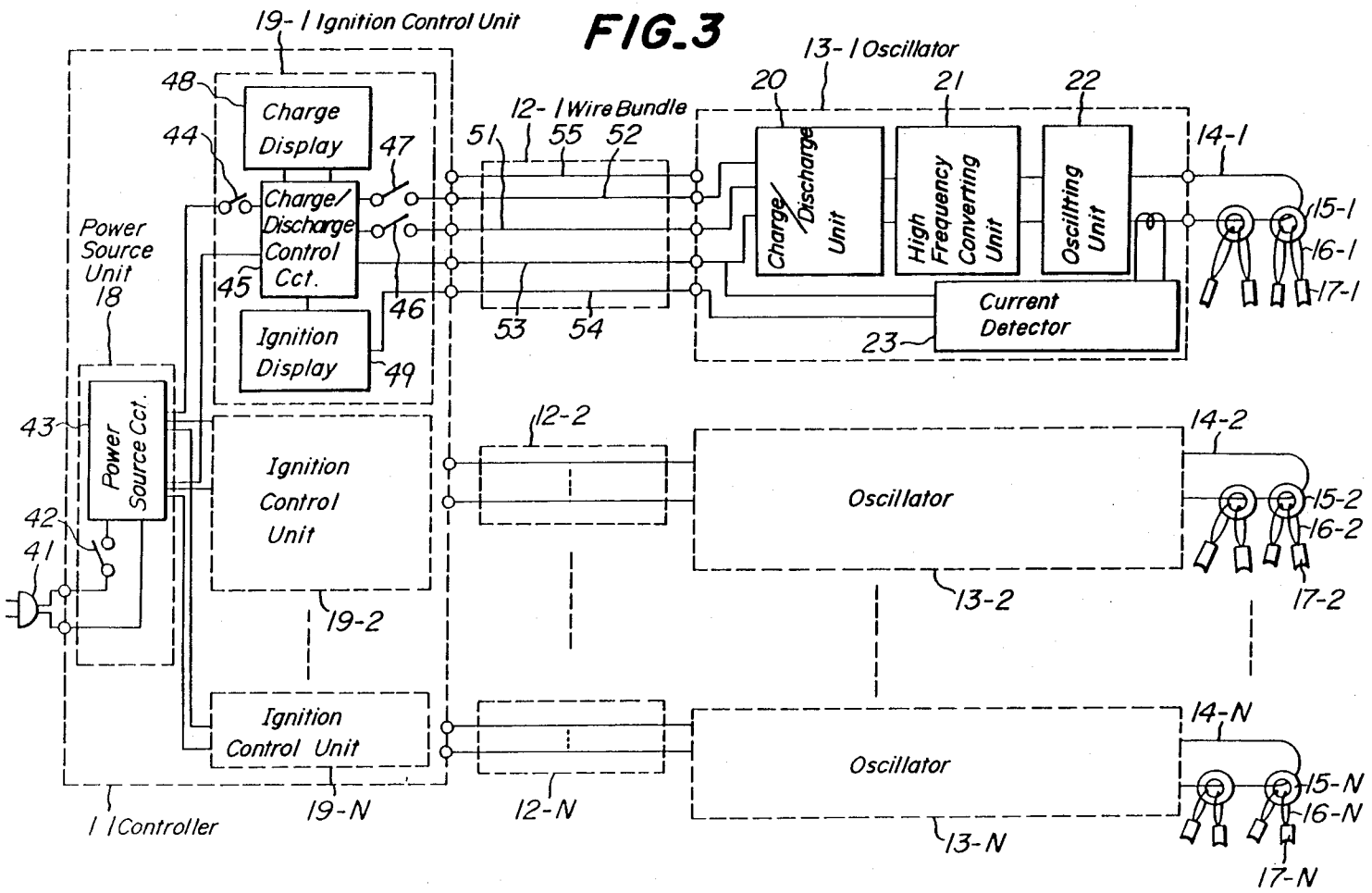
FIG. 3 is a block diagram depicting an embodiment of the electric blasting apparatus according to the invention.
Figure 4:
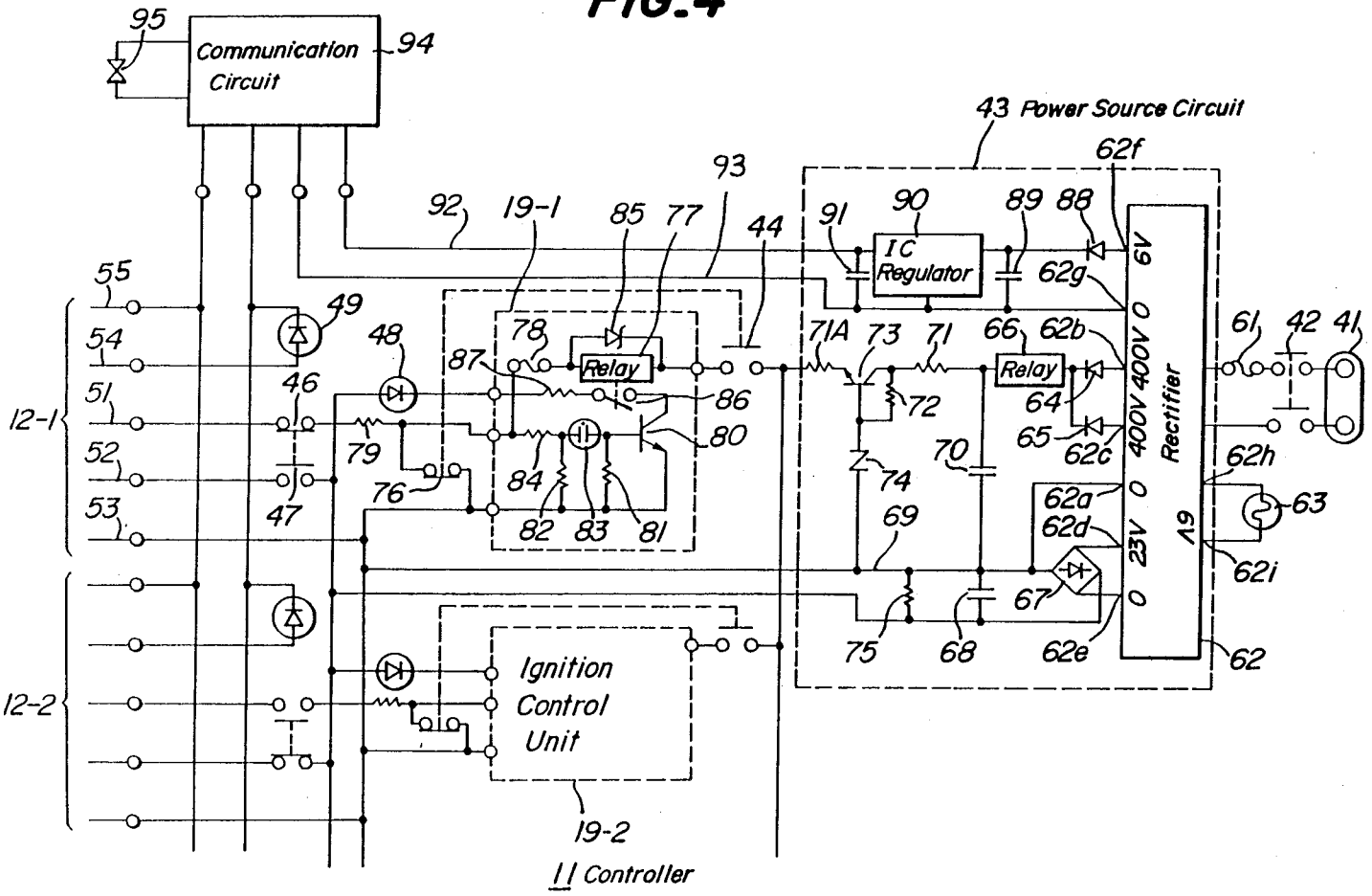
FIG. 4 is a circuit diagram showing the detailed construction of the oscillator shown in FIG. 3.
Figure 5:
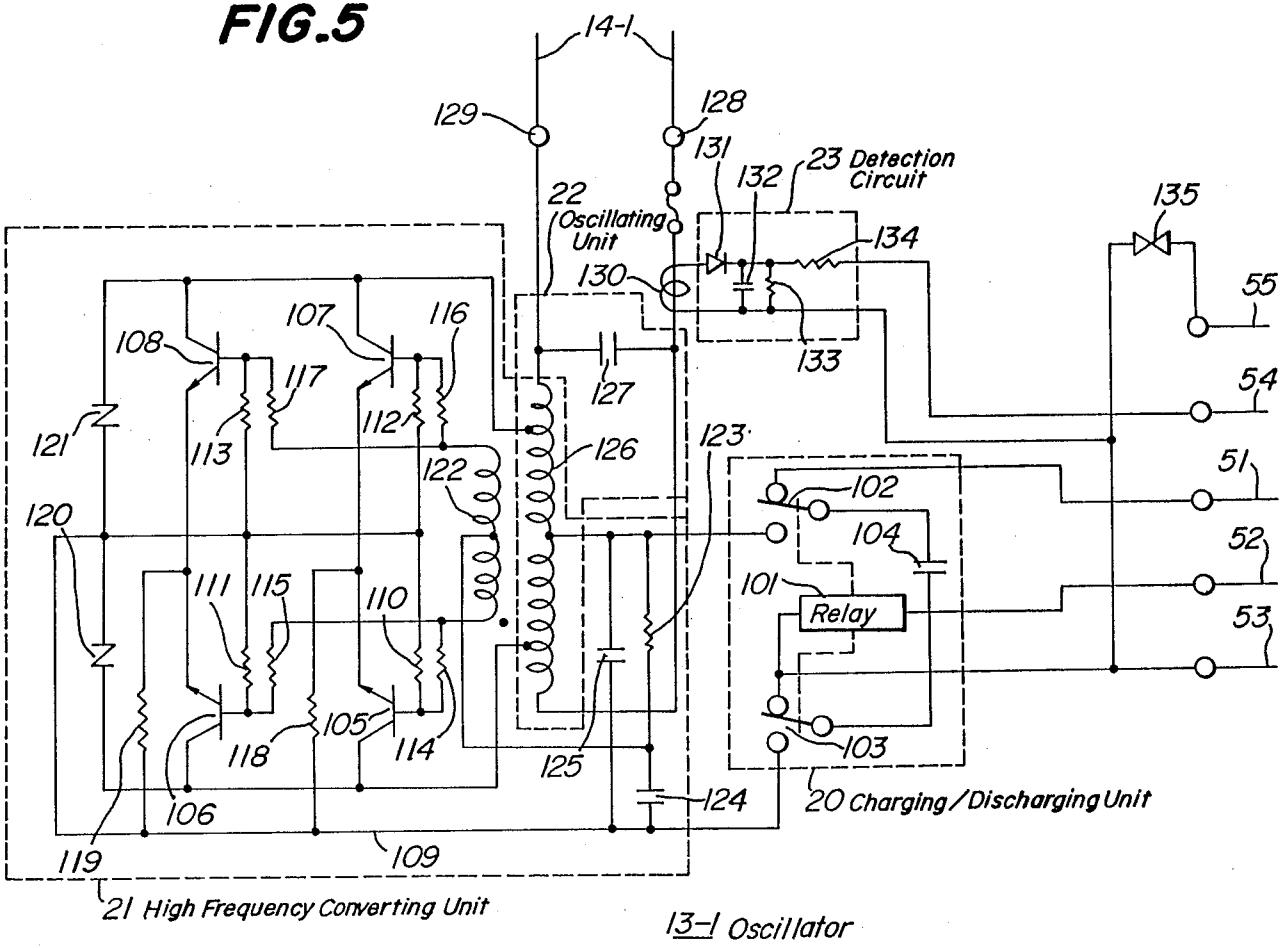
FIG. 5 is a circuit diagram illustrating the detailed construction of the controller depicted in FIG. 3.

FIG. 3 is a block diagram illustrating a whole construction of an embodiment of the electric blasting apparatus according to the invention for use in the electric blasting method according to the invention, FIG. 4 is a circuit diagram showing a detailed construction of the controller, and FIG. 5 is a circuit diagram depicting a detailed construction of the oscillator.

As shown in FIG. 3, a controller 11 comprises a single power source unit 18 and a plurality of ignition control units 19-1, 19-2, . . . 19-N, the number of which is equal to that of oscillators 13-1, 13-2, . . . 13-N. The ignition control units have the identical construction and thus only the ignition control unit 19-1 will be explained hereinbelow. The power source unit 18 comprises a socket 41 for connecting the controller 11 to an A.C. 100 V commercially available power source line, power switch 42 and a power source circuit 43. The power source circuit 43 has plural sets of output terminals, each being connected to respective ignition control units 19-1, 19-2, . . . 19-N. The ignition control unit 19-1 comprises main switch 44, charge/discharge control circuit 45, charging switch 46, ignition switch 47, charge display device 48 and ignition display device 49. Each of electric wire bundles 12-1, 12-2, . . . 12-N for connecting the ignition control units 19-1, 19-2, . . . 19-N to the oscillators 13-1, 13-2, . . . 13-N is formed by a harness including five electric conductors 51~55. The conductor 53 is connected to the ground, the charging current is supplied via the conductors 51 and 53, the ignition command is transmitted from the controller to the oscillator through the conductors 52 and 53, and a detection signal which is generated upon detection of the high frequency current is transmitted from the oscillator to the controller via the conductors 54 and 53. Further, the communication with telephone between the controller and oscillator can be carried out over the conductors 55 and 53.

The oscillators 13-1, 13 2, . . . 13-N have the same construction and thus only the oscillator 13-1 will be explained. The oscillator 13-1 comprises a charge/discharge unit 20 which stores the D.C. current supplied via the conductors 51, 53 from the controller 11 and discharges the stored charge in response to the ignition command transmitted from the controller 11 over the conductors 52, 53, a high frequency converting unit 21 for converting the discharged energy into the high frequency energy, an oscillating unit 22 energized with the high frequency energy and generating the high frequency current of 70~110 KHz, and a current detecting circuit 23 which detects the supply of the high frequency current to the lead wire 14-1 and supplies the detection signal to the ignition control unit 19-1 via the conductors 54, 53.

FIG. 4 shows the detailed construction of the power source unit 18 shown in FIG. 3. The socket 41 connectable to the 100 V A.C. supply line is connected via the power switch 42 and fuse 61 to an AC-DC rectifier 62 of the power source circuit 43. The AC-DC rectifier 62 includes output terminals 62*a*~62*i* at which voltages having various values are applied as illustrated in FIG. 4. At the output terminals 62*h* and 62*i* there is applied an A.C. voltage of 6 V for energizing a power on/off lamp 63. The output terminals 62*b* and 62*c* are connected via diodes 64 and 65 to a relay 66. The output terminal 62*a* is the ground terminal and is connected to one of the output terminals of a full wave rectifier 67 whose input terminals are connected to the output terminals 62*d* and 62*e* of the rectifier 62. The other output terminal of the full wave rectifier 67 is connected to the one terminal of a capacitor 68 the other terminal of which is connected to a ground line 69 connected to the output terminal 62*a*. Across the ground line 69 and the relay 66 is connected a capacitor 70.

A junction point between the relay 66 and capacitor 70 is connected via a resistor 71 to a collector of a transistor 73 whose base is connected via a resistor 72 to the collector. The base of transistor 73 is connected to the ground line 69 by means of a varistor 74. A resistor 75 is connected in parallel with the capacitor 68. An emitter of transistor 73 is connected to the main switch 44 via a resistor 71A.

The charge/discharge control circuit 45 includes a short-circuiting switch 76 which is actuated in conjunction with the main switch 44. The main switch 44 is connected via relay 77, fuse 78 and resistor 79 to the charging switch 46. To the ground line 69 connected to the ground conductor 53 are connected one terminal of resistors 81 and 82. The other end of the resistor 81 is connected to a base of transistor 80 and the other end of resistor 82 is connected by means of a neon tube 83 to the other end of resistor 81 and at the same time is conected via a resistor 84 to a junction point between the fuse 78 and resistor 79. A collector of transistor 80 is connected through a contact 86 driven by the relay 77, resistor 87 and charge display device 48 composed of a light emitting diode to the ignition switch 47 connected to the conductor 52.

Across the output terminals 62*f* and 62*g* of the AC-DC rectifier 62 is connected a series circuit of diode 88 and capacitor 89, and this capacitor 89 is connected to an IC regulator 90. Across output terminals of the IC regulator 90 is connected a capacitor 91 whose terminals are connected to output lines 92 and 93 to generate a regulated D.C. voltage of 6 V across the output lines. To the output lines is connected a communication circuit 94 to which is further connected a telephone set 95 which is connectable via the conductors 55 and 53 to telephone sets provided in respective oscillators 13-1~13-N.

FIG. 5 is a circuit diagram showing the detailed construction of the oscillator 13-1. The charging/discharging unit 20 includes a relay 101 connected across the conductors 52 and 53, relay contacts 102, 103 driven by the relay 101 and a capacitor 104. FIG. 5 represents the condition prior to or during the charging, and the capacitor 104 is connected across the conductors 51 and 53. The high frequency conversion unit 21 comprises four switching transistors 105~108, resistors 110~113 each connected across bases of respective transistors and a conductor 109, resistors 114~117 each connected to bases of respective transistors, resistors 118, 119, a varistor 120 connected across collectors of transistors 105, 106 and the conductor 109, a varistor 121 connected across collectors of transistors 107, 108 and the conductor 109, a coil 122 forming a transformer together with a coil 126, a resistor 123 and capacitors 124, 125. The resistor 118 is connected across commonly coupled emitters of transistors 105, 107 and the conductor 109, and the resistor 119 is connected across commonly coupled emitters of transistors 106, 108 and the conductor 109. The resistor 123 and capacitor 124 are connected in a series circuit which is connected between the relay contacts 102 and 103 of the charging/discharging unit 20, and the capacitor 125 is connected across the series circuit of the resistor 123 and capacitor 124. A junction point of the resistor 123 and capacitor 124 is connected to a middle tap of the coil 122 whose both ends are connected to commonly coupled one terminals of resistors 114, 115 and to commonly coupled one terminal of resistors 116, 117.

The oscillating unit 22 includes the coil 126 of the transformer and a capacitor 127 connected in parallel with the coil 126, and supplies the high frequency current to the lead wire 14-1 connected to output terminals 128 and 129. The oscillating unit 22 comprises the LC resonating circuit composed of the coil 126 and capacitor 127 and a resonance frequency f is represented by $$f = \frac{1}{2\pi\sqrt{LC}}.$$

In the present embodiment, L=50 μH and C=0.047 μF are selected, so that f=104 KHz. It is preferable that the resonance frequency is set to a value within a range of 70~110 KHz.

The current detection circuit 23 comprises a coil 130 electromagnetically coupled with the output line of the oscillation unit 22, a diode 131 connected to the coil, a capacitor 132, and resistors 133, 134. The detection signal is supplied to the controller 11 via the conductors 54 and 53. The oscillator further includes a telephone set 135 connected to the conductors 55, 53 so that the communication can be established between the telephone set 95 provided in the controller 11.

Now the operation of the blasting apparatus will be explained. At first the power switch 42 of the power source unit 18 in the controller 11 is closed to generate given voltages at the output terminals 62*a*~62*i* of the AC-DC rectifier 62 in the power source circuit 43. Next the main switch 44 in the ignition control unit 19-1 is closed and at the same time the switch 76 is opened. Then the D.C. voltage of 400 V generated across the output terminals 62*b*, 62*c* and 62*a* are applied to the conductors 51 and 53 by means of the relay 66, resistor 71, transistor 73, resistor 71A, switch 44, relay 77, fuse 78, resistor 79 and switch 46. Therefore, the capacitor 104 provided in the charging/discharging unit 20 of the oscillator 13-1 is charged. Since the relay 77 is energized, its contact 86 is closed and a voltage corresponding to the terminal voltage of capacitor 104 is applied to the neon tube 83. When the voltage across the capacitor 104 is low, the voltage across the neon tube 83 is also low so that the neon tube is non-conductive. Therefore, the base potential of the transistor 80 is low and thus the transistor is non-conductive and the light emitting diode 48 in the ignition control unit 19-1 is not lit. When the voltage across the capacitor 104 is increased, the neon lamp 83 becomes conductive and the base potential of the transistor 80 is also increased. Therefore, the transistor 80 becomes conductive and the light emitting diode 48 is lighted on. In this manner, the operator operating the controller 11 can check whether the capacitor 104 provided in the oscillator 13-1 located far from the controller has been charged up to a predetermined voltage by monitoring the condition of the light emitting diode 48 provided in the controller 11.

After confirming the charging up of the capacitor 104 by watching the light emitting diode 48, the switch 46 is opened to disconnect the capacitor 104 from the charging circuit and at the same time the switch 47 is closed to apply the D.C. voltage of 23 V appearing across the output terminals 62*d* and 62*e* to the conductors 52 and 53. Then the relay 101 in the charging/discharging unit 20 is energized and its contacts 102 and 103 are changed into positions opposite to those shown in FIG. 5. Then the charge stored in the capacitor 104 is discharged into the high frequency conversion unit 21. The high frequency conversion unit 21 constitutes a transistor type inverter and the transistor pairs 105, 106 and 107, 108 are made conductive alternately. Therefore, the current passes through upper and lower halves of the primary coil 122 in opposite directions, and thus the high frequency current having a frequency determined by the LC resonance circuit of the oscillation unit 22 is induced in the secondary coil 126. The high frequency current thus generated is supplied to the lead wire 14-1 via the output terminals 128, 129. When the high frequency current passes, the high frequency current is induced in the coil 130 of the current detection circuit 23. The induced high frequency current is rectified by the diode 131 to generate the D.C. detection signal which is supplied via the conductors 54, 53 to the controller 11. Then the light emitting diode 49 in the ignition control unit 19-1 is energized to light on.

In the present embodiment, in the condition in which the oscillator 13-1 is connected to the controller 11 via the cnductor bundle 12-1, the capacitor 104 is short-circuited by the switch 76 provided in the controller, the capacitor could not be erroneously charged to cause any accident. Further, after the main switch 44 has been closed to initiate charge to the capacitor, when it is required to stop the explosion due to any reason, the main switch 44 is opened and the switch 76 is closed to short-circuit the capacitor 104 to discharge the charge stored in the capacitor. In this manner, the explosion can be carried out in a very safe manner.

By effecting the above mentioned operation for ignition control units 19-1~19-N corresponding to the oscillators 13-1~13-N, it is possible to blast the detonators at a plurality of working faces in a centrally controllable manner. In this case, the ignition control units may be operated separately or all the capacitor 104 in all the oscillators 13-1~13-N are first charged and then the ignition switches 47 in the ignition control units 19-1~19-N may be actuated separately.

Now several examples of the electric blasting method according to the invention will be explained.

One controller 11 shown in FIG. 4 and ten oscillators 13-1~13-10 illustrated in FIG. 5 were used. The oscillators were designed to generate the high frequency current of about 100 KHz. The controller 11 was energized with the commercially available A.C. 100 V. Each of wire bundles 12-1~12-10 for connecting the oscillators to the controller was constructed by a harness including five conductors each having a cross sectional area of about 0.75 $mm^2$ (0.02 Ω/m). The wire bundles had the lengths shown in a Table 1. To each oscillators 13-1~13-10 were connected lead wires 14-1~14-10, respectively having lengths represented in the table each lead wire being formed by the low impedance lead wire manufactured by Nippon Oil and Fats Company, Limited. To each lead wires were further connected auxiliary lead wires, each having a length of 50 m and a loop portion. Forty transformer cores 15 were coupled with each loop portion and to each transformer core were coupled five electric detonators having a leg wire of 3.0 m length. The transformer core was formed by a rectangular core having a side length of 15 mm and a thickness of 10 mm. The ten oscillators were controlled by the controller and the detonators were exploded by supplying the high frequency currents to the lead wires. The result is shown in the table.

TABLE 1

| Oscillator No. | Length of wire bundle | Length of bus wire | Number of cores | Number of detonators | Condition of explosion |
|---|---|---|---|---|---|
| 1 | 170 | 100 | 40 | 200 | all exploded |
| 2 | 250 | 150 | 40 | 200 | all exploded |
| 3 | 280 | 300 | 40 | 200 | all exploded |
| 4 | 340 | 100 | 40 | 200 | all exploded |
| 5 | 370 | 150 | 40 | 200 | all exploded |
| 6 | 450 | 200 | 40 | 200 | all exploded |
| 7 | 530 | 150 | 40 | 200 | all exploded |
| 8 | 1520 | 100 | 40 | 200 | all exploded |
| 9 | 3580 | 300 | 40 | 200 | all exploded |
| 10 | 5230 | 100 | 40 | 200 | all exploded |

The present invention is not limited to the embodiment explained above, but many modifications and alternations may be conceived by those skilled in the art within the scope of the invention. In the above numerical examples, the transformer cores are electromagnetically coupled with the loop portions of auxiliary lead wire, but they may be coupled with the loop portion of the main lead wire. In the above embodiment, the completion of charging and the generation of the high frequency current can be monitored at the controller, if these faculties are not required, the charging display, ignition display, current detection circuit and conductors for the detection signal may be all deleted. Then, the wire bundle may be formed by a harness with three conductors. Moreover, if the charging conductor and ignition control conductor are commonly used, the harness may include only two conductors.

In the embodiment so far explained, the oscillator generates the high frequency current which is transferred to the leg wire of the detonator via the transfer core, but it is also possible to discharge the electric charge stored in the oscillator toward the leg wire of the detonator directly. In such a case the leg wire is directly connected to the discharging circuit of the capacitor.

As explained above in detail, in the electric blasting method according to the invention, a plurality of the oscillators each arranged near respective working faces can be controlled by the single controller arranged far from the working faces, so that the large scale explosion can be performed in a positive and safe manner. That is to say, all the working faces can be free from the workers and thus the problem of the aftergas can be effectively solved. Further, the controller and oscillators are connected via the wire bundles and the oscillators are energized with the D.C. current, so that the electric energy can be efficiently transferred through the long wire bundles up to several kilometers with a very small loss and the electric detonators can be positively exploded.

What is claimed is:

1. A method of electrically blasting a plurality of electric detonators arranged at different locations, comprising the steps of:

arranging a plurality of electric detonators at each blasting faces, each electric detonator including leg wires;

arranging a plurality of electric blasting devices near respective blasting faces, each electric blasting device including a charging/discharging unit;

coupling said leg wires of electric detonators arranged at each blasting face with an electric blasting device arranged near the relevant blasting face;

arranging a controller at a location suitable for controlling said plurality of electric blasting devices in a central control mode, said controller including a power source unit for generating a D.C. current and an ignition control unit;

connecting said plurality of electric blasting devices to said controller by means of electric wires;

supplying the D.C. current generated by said power source unit of the controller to the electric blasting devices via said electric wires to store electric energy in said charging/discharging units in the electric blasting devices; and discharging the electric energy stored in the charging/discharging units in the electric blasting devices such that electric currents flow through the leg wires of the electric detonators to explode the electric detonators.

2. A method according to claim 1, wherein said step of coupling the leg wires of the electric detonator comprises connecting a lead wire having at least one loop portion to an oscillating unit which is provided in an electric blasting device and is energized with the electric energy discharged from the charging/discharging unit to generate a high frequency current;

inserting the loop portion of the lead wire to a transformer magnetic core; and inserting the leg wires of the electric detonator in the form of a loop-like wire to said transformer magnetic core.

3. A method according to claim 2, wherein each of said plurality of electric blasting devices is connected with the aid of an electric wire bundle including at least two conductors to a respective one of the ignition control units provided in the controller, a charging/discharging unit of an electric blasting device is energized by closing a charging switch provided in an ignition control unit corresponding to said electric blasting device to store electric charge in a capacitor provided in a charging/discharging unit, and said electric charge is discharged by closing an ignition switch provided in said ignition unit.

4. A method according to claim 3, wherein after all the capacitors provided in the charging/discharging units of all the electric blasting devices have been charged, the ignition switches for respective electric blasting devices are selectively closed.

5. A method according to claim 3, wherein after a capacitor provided in an electric blasting device has been charged by closing charging switch provided in an ignition control unit corresponding to said electric blasting device, the electric charge stored in the capacitor is discharged by closing the ignition switch provided in said ignition control unit.

6. An apparatus for blasting a plurality of electric detonators comprising a controller including a power source unit for generating a D.C. voltage and an ignition control unit for selectively supplying said D.C. voltage;

a plurality of oscillators, each of which is connected to said controller by means of electric wires, and comprises a charge/discharge unit energized with the D.C. voltage applied from said controller and discharging stored electric charge in accordance with an ignition command supplied from said controller, a high frequency conversion unit for converting the discharged electric charge into high frequency energy, and an oscillation unit energized with said high frequency energy for generating a high frequency current having a predetermined frequency;

a plurality of lead wires each being connected to respective oscillators; and a plurality of transformer cores electromagnetically coupled with said lead wires, said transformer cores being electromagnetically coupled with loop like leg wires of the electric detonators.

7. An apparatus according to claim 6, wherein said controller comprises a plurality of ignition control units, the number of which is equal to that of the oscillators, each ignition control unit being connected to corresponding oscillators via respective electric wire bundles.

8. An apparatus according to claim 7, wherein each of said ignition control units in the controller comprises a charging switch for applying the D.C. voltage to an oscillator, and an ignition switch for supplying the ignition command to said oscillator.

9. An apparatus according to claim 8, wherein each of said ignition control units further comprise a charge display device for indicating that the charge/discharge unit in the relevant oscillator has been charged up to a predetermined level.

10. An apparatus according to claim 9, wherein said charge display device comprises a voltage detection circuit for detecting a voltage across a capacitor provided in the charge/discharge unit via the wire bundle, a voltage comparison circuit for comparing the detected voltage with a predetermined voltage and producing a signal when the detected voltage exceeds the predetermined voltage, a switching circuit driven by said signal generated by the voltage comparison circuit to generate an actuation signal and a light emitting device energized with said actuation signal.

11. An apparatus according to claim 8, wherein each of said ignition control circuits further comprises an ignition display device for indicating that the oscillating unit in the relevant oscillator generates the high frequency current.

12. An apparatus according to claim 11, wherein said oscillator comprises a current detection circuit for detecting the generation of the high frequency current to produce a detection signal, and said ignition display device comprises a light emitting device energized with said detection signal supplied from the oscillator via the wire bundle.

13. An apparatus according to claim 8, wherein said controller comprises a communication circuit and a telephone set connected to the communication circuit and each of said oscillators comprises a telephone set connected to said communication circuit via the wire bundle.

14. An apparatus according to claim 8, wherein said power source unit provided in the controller produces the D.C. voltage of about 150~500 volts.

15. An apparatus according to claim 8, wherein said oscillating unit provided in the oscillator generates the high frequency current having a frequency of 70~110 KHz.

* * * * *